US005992812A

United States Patent [19]

Mark

[11] Patent Number: 5,992,812

[45] Date of Patent: Nov. 30, 1999

[54] SHOCK ABSORBING CORNER IMPACT

[75] Inventor: Roger Mark, Barrington, R.I.

[73] Assignee: Bose Corporation, Framingham, Mass.

[21] Appl. No.: 08/178,068

[22] Filed: Jan. 6, 1994

[51] Int. Cl.[6] ..... A47B 95/00

[52] U.S. Cl. ..... 248/345.1; 206/586

[58] Field of Search ..... 248/345.1, 903, 248/300; 206/586, 523; 312/263, 400, 140; 181/199, 151, 146

[56] References Cited

U.S. PATENT DOCUMENTS

| | | | |
|---|---|---|---|
| 2,674,433 | 4/1954 | Mautner | 206/586 X |
| 3,030,728 | 4/1962 | Wesman | 248/345.1 |
| 3,063,613 | 11/1962 | McClive | 206/586 X |
| 3,762,626 | 10/1973 | Dorsey | 248/345.1 X |
| 3,922,408 | 11/1975 | Smith | 248/345.1 X |
| 3,973,720 | 8/1976 | Schmid . | |
| 5,002,368 | 3/1991 | Anglin . | |
| 5,115,917 | 5/1992 | Schrage | 206/586 |
| 5,218,176 | 6/1993 | Meyer, Jr. | 181/199 |

*Primary Examiner*—Derek J. Berger
*Attorney, Agent, or Firm*—Fish & Richardson P.C.

[57] ABSTRACT

A shock absorbing system includes a housing having at least one corner angle, a corner cap outside each corner angle, and energy absorbing material filling the region between the corner angle and the corner cap. The energy absorbing material exhibits high stiffness under normal operating conditions and low stiffness during impact. The shock absorbing system is constructed and arranged to permit shearing action and compression during impact.

13 Claims, 2 Drawing Sheets

SHOCK ABSORBING CORNER IMPACT

The present invention relates in general to shock absorbing and more particularly concerns novel apparatus for absorbing shock in housings such as loudspeaker cabinets, thereby helping to reduce the risk of damage from impact.

BACKGROUND OF THE INVENTION

It is an important object of this invention to provide improved apparatus and techniques for shock absorbing.

It is another object of the invention to achieve the preceding object without adding significant weight or size to a portable cabinet.

SUMMARY OF THE INVENTION

According to the invention, a housing has at least one corner angle with a corner cap outside the corner angle and energy absorbing material filling a region between the corner angle and the corner cap constructed and arranged so that the corner angle receives external forces through the energy absorbing material. The energy absorbing material exhibits a first stiffness under normal operating conditions in a first operating region when the force on the material is less than a predetermined threshold value and a second stiffness significantly less than the first stiffness during impact in a second operating region when the force on the material is greater than the predetermined threshold level. According to one aspect of the invention, the energy absorbing material is a closed cell foam exhibiting high stiffness under normal operating conditions and low stiffness during impact. According to another aspect of the invention, a corner angle comprising a metal angle and a corner cap comprising a metal cover are joined to the energy absorbing material by an adhesive. According to another aspect of the invention, the shock isolating system is constructed and arranged to provide shearing action and compression during impact.

The energy absorbing material exhibits a first stiffness under normal operating conditions in a first operating region when the force on the material is less than a predetermined threshold value and the energy absorbing material is deflected less than a first distance, a second stiffness during impact in a second operating region when the force on the material is greater than the predetermined threshold value and the energy absorbing material is deflected more than the first distance and less than a second distance and a third stiffness in a third operating region during impact when the second energy absorbing material is deflected more than the second distance. The first stiffness and the third stiffness are significantly higher than the second stiffness.

In an exemplary embodiment of the invention, the shock isolating system is constructed and arranged so that the corner angle reinforces housing joints with which it makes contact. According to another aspect of the exemplary embodiment of the invention, the metal cover comprises continuous corrugations.

According to another aspect of the invention, the housing comprises a loudspeaker cabinet, typically having four corner caps.

Numerous other features, objects and advantages of the invention will become apparent from the following detailed description when read in connection with the accompanying drawings in which:

DETAILED DESCRIPTION

Figure 1:
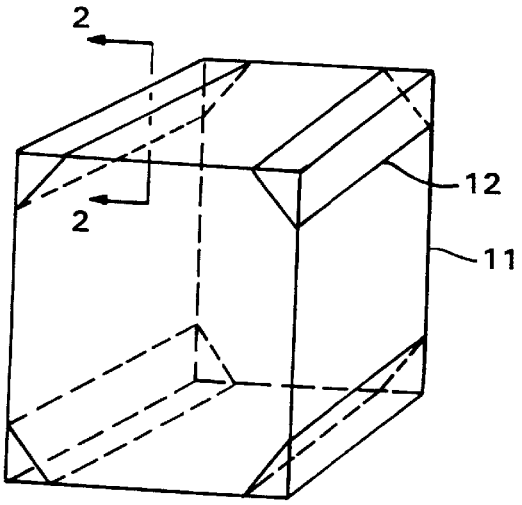
FIG. 1 is a perspective view of a loudspeaker cabinet with a shock absorbing system according to the invention.

With reference now to the drawings and more particularly FIG. 1 thereof, there is shown a perspective view of an embodiment of the invention comprising a housing 11, such as a loudspeaker cabinet, and four shock isolating systems 12, each extending from front to rear of the housing and embracing a pair of housing corners and the joint extending between the corners.

Figure 2:
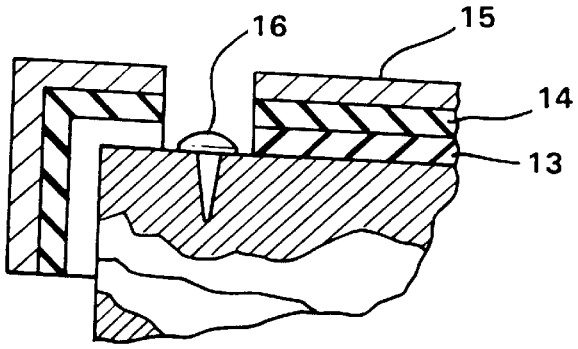
FIG. 2 is a fragmentary sectional view of the housing, inside corner angle, energy absorbing material, and corner cap.

Referring to FIG. 2, there is shown a fragmentary sectional view through Section 2—2 of FIG. 1. Screws, such as 16, secure an inside corner angle 13 to housing 11 and are accessible through clearance openings in energy-absorbing material 14 and outside corner cap 15. Adhesive 17 secures energy-absorbing material 14 to outer corner cap 15 and inner corner angle 13.

Figure 3C:
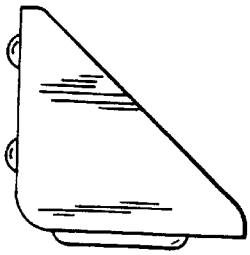
FIGS. 3A, 3B and 3C are plan, elevation and end views of a specific form of corner cap.
Figure 3A:
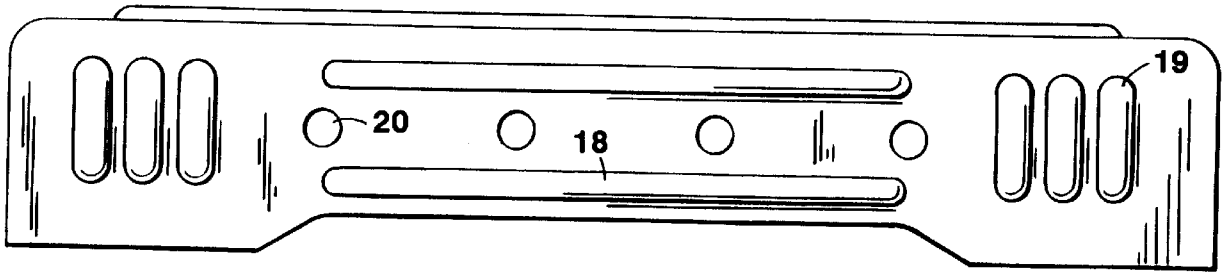
Figure 3B:
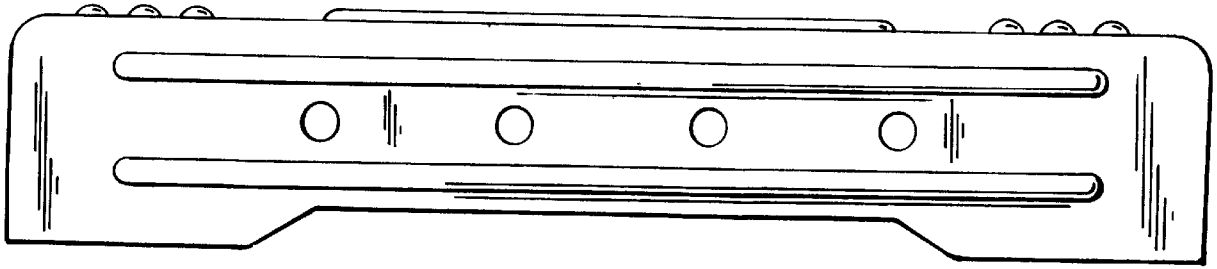

Referring to FIGS. 3A, 3B and 3C, there are shown plan, elevation and end views, respectively, of a specific form of outer corner cap 15. Corner cap 15 has lengthwise corrugations 18 for stiffening the structure and more evenly distributing the load over energy-absorbing material 14. Transverse corrugations 19 on normally horizontal surfaces 15H intermesh with those on another housing to facilitate stacking housings. Outer corner cap 15 and energy-absorbing material 14 are formed with clearance holes 20 to allow access to screws 16. Two triangular-shaped (FIG. 3C) and two nearly rectangular-shaped sections (FIG. 3A) of energy-absorbing material 14 completely line the inside surface of outer corner cap 15.

Figure 4:
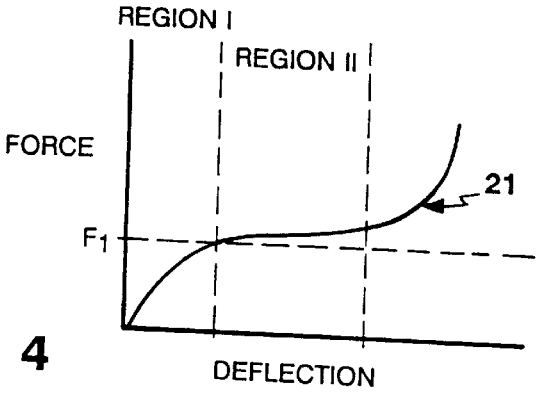
FIG. 4 is a graphical representation of the stiffness characteristic of the energy absorbing material.

Referring to FIG. 4, there is shown a graphical representation of the preferred stiffness characteristic of shock-absorbing material 14 illustrating the relationship between force and deflection of the shock-absorbing material 14. This stiffness characteristic is nearly bilinear and is fully reversible, as distinguished from occurring only once. The stiffness (slope of characteristic curve 21) is high for small forces under normal operating conditions to maintain stability of the cabinet at rest when the force on shock-absorbing material 14 is less than a predetermined threshold value $F_1$. This region of normal operation is designated Region I.

Upon impact producing a force on outer corner cap 15 and shock-absorbing material exceeding $F_1$, operation is in the low stiffness Region II where a relatively small increase in force produces a large deflection, allowing energy-absorbing material 14 to absorb a significant portion of the impact energy that would otherwise act on housing 11, thereby significantly reducing the effect of the impact on housing 11. This low stiffness is significantly less than the high stiffness in Region I.

When the deflection exceeds the range of deflections in Region II, the shock-absorbing material 14 exhibits a third stiffness that is significantly higher than the stiffness exhibited during operation in Region II.

Energy-absorbing material 14 is typically multiple pieces of closed-cell foam with a density range of 15–30 lbs/ft$^3$ and stiffness so as to keep creep and permanent set low at high storage temperatures. A suitable material is microcellular polyurethane material, such as PORON material commercially available from Rogers Corporation, East Stockwood, Conn., typically 0.25-inch thick. The material for the outer corner cap 15 is typically 0.060-inch thick quality cold rolled steel (#16 gauge) finished with zinc plate with yellow chromate conversion perams-2402-5 and black powder coating. The material for the inner corner plate 13 is the same. A suitable adhesive for fastening the shock-absorbing material to the inner and outer plates is HB Fuller contact adhesive SC-0106.

The invention has a number of advantages. By taking advantage of both shearing action and compression, less shock-absorbing material may be used to achieve a given degree of shock isolation. The inner metal angle plate 13 additionally functions to reinforce the housing joints between contiguous panels. The outer corner cap resists wear, protects the energy-absorbing material from the environment and reduces the risk of high localized stress in the shock-absorbing material by distributing the forces caused by impact along its length. The structure has a low profile and is lightweight. The invention has an additional advantageous property of attenuating high levels of structureborne noise and vibration.

In a commercial embodiment of the invention protecting the corners of a BOSE 502B ACOUSTIMASS bass enclosure weighing 85 pounds, the invention enables this cabinet to withstand a two-foot drop upon a hard concrete surface without damage.

*In an alternative embodiment, hard, high impact plastic or composite replaces the metal angle and metal cover. In an additional alternative embodiment, the polyurethane closed cell foam is replaced by an alternative plastic. In an additional alternative embodiment, heat fusing replaces use of the adhesive. In an additional alternative embodiment, one piece foam construction replaces multiple pieces of foam.

Other embodiments are within the claims.

What is claimed is:

1. A shock absorbing system comprising, a housing having at least one corner, a corner cap outside said at least one corner, energy absorbing material filling a region between said at least one corner and said corner cap constructed and arranged so that said at least one corner receives external forces through said energy absorbing material, wherein said energy absorbing material exhibits a first stiffness under normal operating conditions in a first operating region when the force on said material is less than a predetermined threshold value and said energy absorbing material is deflected less than a first distance, a second stiffness during impact in a second operating region when the force on said material is greater than said predetermined threshold value and said energy absorbing material is deflected more than said first distance and less than a second distance and a third stiffness in a third operating region during impact when said energy absorbing material is deflected more than said second distance, said first stiffness and said third stiffness being significantly higher than said second stiffness.

2. A shock absorbing system in accordance with claim 1 wherein said energy absorbing material comprises closed-cell foam.

3. A shock absorbing system in accordance with claim 1 wherein said at least one corner comprises a metal angle.

4. A shock absorbing system in accordance with claim 3 wherein said housing has at least one joint and said metal angle reinforces said at least one joint.

5. A shock absorbing system in accordance with claim 1 wherein said corner cap comprises a metal cover.

6. A shock absorbing system in accordance with claim 5 wherein said metal cover is constructed and arranged to provide wear resistance, protect said energy absorbing material, and reduce conditions of high localized stress by distributing impact force to said shock absorbing material over the area between said shock absorbing material and said metal cover.

7. A shock absorbing system in accordance with claim 5 wherein said metal cover comprises continuous corrugations.

8. A shock absorbing system in accordance with claim 1 and further comprising adhesive joining said at least one corner and said corner cap to said energy absorbing material.

9. A shock absorbing system in accordance with claim 1 wherein said corner cap is mounted to said housing by screws.

10. A shock absorbing system in accordance with claim 1 wherein said at least one corner, said shock absorbing material and said corner cap are constructed and arranged to provide shearing action among said at least one corner, said shock absorbing material and said corner cap and compression of said shock absorbing material during impact.

11. A shock absorbing system in accordance with claim 1 wherein said housing has at least one joint.

12. A shock absorbing system in accordance with claim 1 wherein said housing is a loudspeaker cabinet.

13. The shock isolating system in accordance with claim 12 wherein four of said corners are corners of said loudspeaker cabinet.

* * * * *